United States Patent [19]

McCaffrey et al.

[11] Patent Number: 5,065,904

[45] Date of Patent: Nov. 19, 1991

[54] PERSONAL PROTECTION DEVICE

[76] Inventors: Joseph T. McCaffrey, 709 Knorr St., Philadelphia, Pa. 19111; Stewart P. McKay, 1091 Kemper Dr., Warminster, Pa. 18946

[21] Appl. No.: 410,715

[22] Filed: Sep. 21, 1989

[51] Int. Cl.[5] ..... B67D 5/00

[52] U.S. Cl. ..... 222/3; 222/78; 135/19.5

[58] Field of Search ..... 222/78–79, 222/3, 174, 182, 191–192, 153, 402.12; 135/16–17, 19.5

[56] References Cited

U.S. PATENT DOCUMENTS

| | | | |
|---|---|---|---|
| 1,283,015 | 10/1918 | Yung | 135/17 |
| 2,893,606 | 7/1959 | Hawkins | 222/174 |
| 2,941,695 | 6/1960 | Rich | 222/174 X |
| 3,038,483 | 6/1962 | Altsheler | 222/79 X |
| 3,432,077 | 3/1969 | Voll | 222/78 |
| 3,730,390 | 5/1973 | Adrian et al. | 222/79 |
| 3,756,467 | 9/1973 | Anketell | 222/78 |
| 3,977,570 | 8/1976 | Smrt | 222/174 |
| 4,170,316 | 10/1979 | LaBarbera | 220/306 |
| 4,223,804 | 9/1980 | Morris et al. | 222/3 |
| 4,449,474 | 5/1984 | Mariol | 116/2 |
| 4,617,951 | 10/1986 | Adams et al. | 135/66 |
| 4,667,851 | 5/1987 | Wilkerson | 222/47 |
| 4,789,084 | 12/1988 | Yoshitomi | 222/174 |
| 4,860,776 | 8/1989 | McQuain | 135/19.5 |

*Primary Examiner*—Michael S. Huppert
*Attorney, Agent, or Firm*—Paul & Paul

[57] ABSTRACT

A personal protection device of the hand-held type comprises a handle, a shaft and a canister section, which is adapted to receive a gas-charged canister containing a noxious compound or spray. The handle is provided with a movable trigger which, when actuated, causes the contents of the canister to discharge. In a preferred embodiment, the shaft is equipped with an umbrella canopy which is oriented to open away from the handle of the device.

21 Claims, 2 Drawing Sheets

PERSONAL PROTECTION DEVICE

BACKGROUND OF THE INVENTION

This invention relates to personal protection devices generally and more specifically relates to portable, hand-held personal protection devices for particular use against animal attacks.

Many types of personal security devices are known from the prior art. Examples of such known devices are disclosed in U.S. Pat. No. 4,449,474 to Mariol and U.S. Pat. No. 4,223,804 to Morris et al. The devices disclosed in the above-mentioned U.S. Patents basically comprise a trigger-actuated compressed gas cylinder which, when actuated, will emit a loud noise and/or a noxious gas, spray, etc. Such devices may also include mechanical whistles, flashlights, etc., and are primarily for use against rapists and other human assailants.

The disadvantages of these devices lies in the fact that such devices are typically short in length so as to make them easily carryable in a purse or pocket. The short length of these devices in turn requires the user of such devices to be relatively close to the assailant for the device to be effective, because the useful range of such devices is dictated by the range of emission of the noxious gas or spray upon discharge. This disadvantage is also known from the simple canisters of MACE® or other sprays commonly used for protection. Still another disadvantage of these known devices is that their efficacy is largely dependent upon environmental conditions, particularly wind velocity. Indeed, in some cases, the discharge of a noxious spray from these devices on a windy day could cause the spray to blow into the face of the user and cause injury or discomfort to the user which was intended for the assailant. The abovementioned disadvantages make such devices particularly unsuitable for use against non-human assailants, such as dogs.

Still other personal protection devices are known, which can generally be described as concealed weapon-type devices. These devices comprise a sword, dagger or gun concealed in a walking stick, cane or umbrella, examples of which are known from U.S. Pat. No. 4,617,951 to Adams & Taylor and U.S. Pat. No. 1,283,015 to Yung. Although such concealed weapons, if used properly, are extremely effective to prevent an unwanted assault, they are not very practical in today's society and are illegal in many jurisdictions.

The need for an effective and practical personal protection device, particularly useful against animal attacks, is widely recognized. Occupations such as mail carriers, utility meter readers and the like are constantly exposed to the threat of attack by dogs and other animals while they conduct their daily routine duties. Some species of dogs, such as the Doberman Pinscher and Bull Terrier, have particularly aggressive personalities and are capable of causing very serious injuries and have been known to do so.

The primary method of avoiding an attack today is escape. This method, however, is not very desirable because there are too many variables which affect its utility. In addition, there have been many instances in which the potential victim becomes seriously injured in the attempt to escape.

Another method of avoiding animal attacks today, apart from the use of a hand-held spray, is to occupy or distract the animal while a safe escape is affected. Such method includes the use of a pole or stick with a ball or other item affixed to its end. The theory behind such a device is to cause the animal to attack the ball at a safe distance while the potential victim retreats. The primary disadvantage of this method, however, is that its effectiveness depends to a large extent upon the cooperation of the attacking animal.

SUMMARY OF THE INVENTION

We have invented a new and novel personal protection device which is particularly useful against animal attacks, but which may also be used against other assailants.

Basically, the present invention comprises an elongate shaft, such as an umbrella or cane, having a handle at one end and a compressed gas canister housing at the other. A gas canister, containing MACE®, pepper spray or other suitable noxious compound is disposed within the housing and its discharge is actuated by a trigger mechanism located in the handle. In the preferred embodiment, the invention utilizes an umbrella whose canopy opens away from the handle; that is, in a direction opposite the typical umbrella.

The personal protection device just described offers several advantages over prior art devices. In the preferred embodiment, the actuation of the umbrella canopy into its open position provides a "shield" at a safe distance from the use which can be used to keep the animal at bay while a safe escape is affected. Indeed, it has been shown that some animals are frightened by the rapid opening of an umbrella to the point of aborting their attack. Upon discharge of the noxious spray from its canister, the umbrella canopy also served to prevent the spray from blowing back into the face of the user.

Accordingly, it is a primary object of the invention to provide a new and novel personal protection device.

It is another object of the invention to provide a personal protection device which is particularly well suited to deter animal attacks.

It is another object of the invention to provide a personal protection device having two means of protection against animal attacks.

It is yet another object of the invention to provide a personal protection device which is simple in construction and is easy to operate and carry.

It is another object of the invention to accomplish the above objects in a personal protection device having an umbrella-type canopy which opens away from the user.

It is still another object of the invention to accomplish the above objects in a personal protection device having a pressurized canister which can be actuated from a remotely located trigger mechanism.

These and other objects of the invention will become apparent upon a further reading of the following specification and the appended claims.

DETAILED DESCRIPTION OF THE EMBODIMENTS

Figures 1, 2:
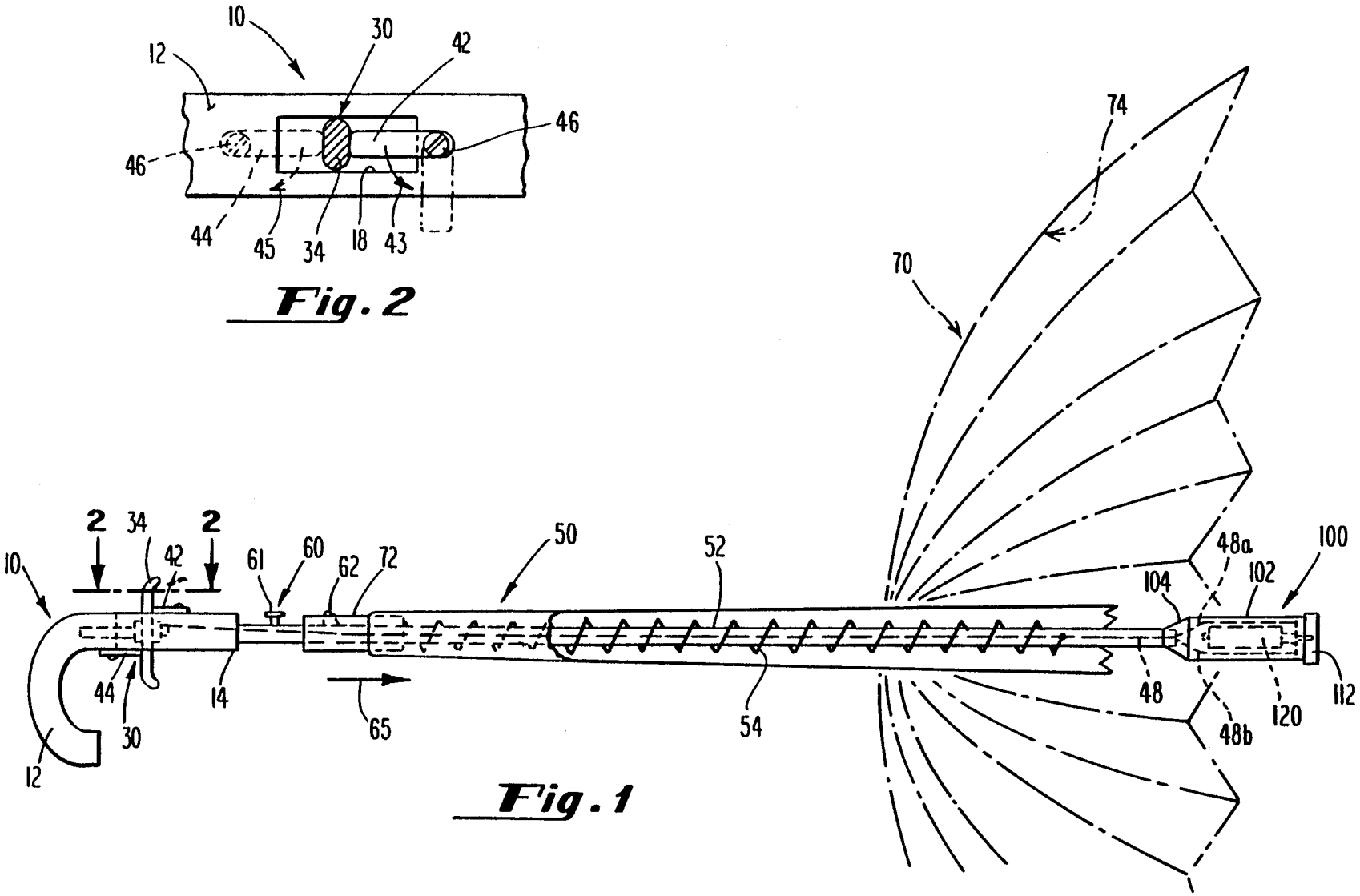
FIG. 1 is a side elevation view, partly in phantom, of a personal protection device in accordance with the present invention, particularly illustrating the umbrella canopy in the open and closed positions, the former being illustrated in broken lines.
FIG. 2 is a plan view of the trigger as seen along line 2—2 of FIG. 1, partially sectioned and partially in phantom, particularly illustrating the detent mechanisms for the trigger.

With reference first being made to the preferred embodiment of the device in FIG. 1, the personal protection device comprises an umbrella-shaped device having a handle section 10, an elongate shaft section 50, a canopy 70 and a canister section 100.

As seen in FIG. 1, shaft section 50 comprises an elongate tube member 52 and a coil spring 54 disposed on the outside of tube 52. The canopy 70 is provided with a collar member 72 and is operably movable between open and closed positions by sliding the collar 72 along the tube member 52 in known fashion. The coil spring 54 is operatively engaged with collar 72 to assist in the opening of the canopy upon release of the canopy detent means 60, all of which is known in terms of operation and construction. The construction of the shaft section 50 and canopy 70 of the present invention differs from the typical umbrella in that the canopy 70, when opened, has its concave inner surface 74 facing outwardly and away from the handle section 10. An umbrella having the above-described construction is commercially available from pet stores and is used to keep pets dry when taking walks on rainy days.

Figure 3:
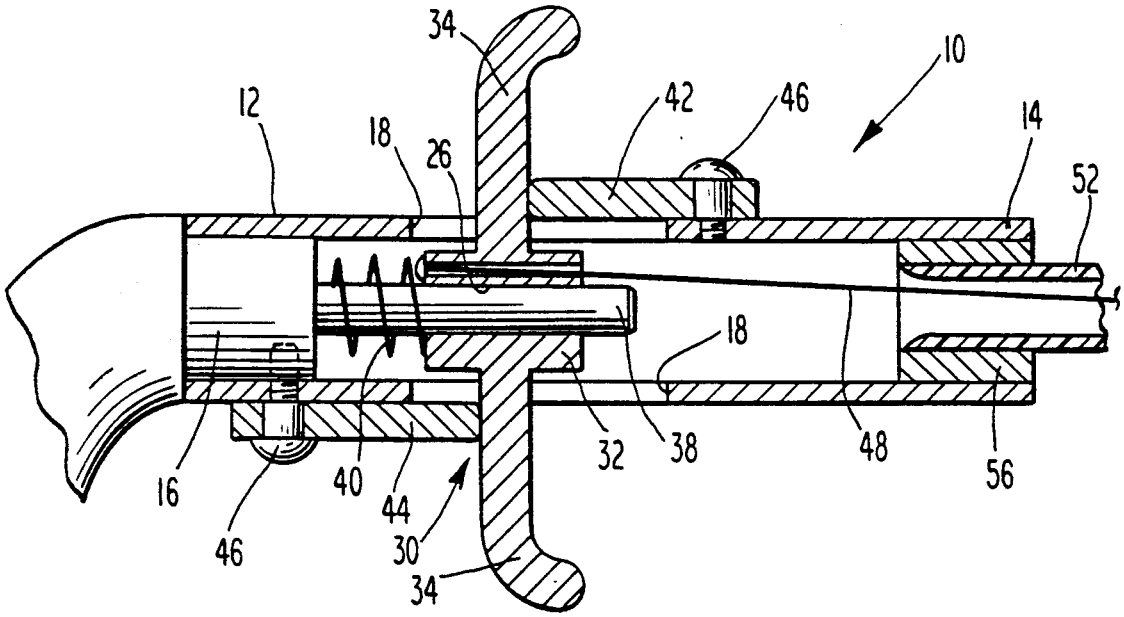
FIG. 3 is a sectional view of the trigger mechanism and handle of the personal protection device.

Reference now being made to FIGS. 1-3, the handle section 10 comprises a handle 12 and a trigger mechanism 30 forming an integral part of handle 12. Handle 12 may be of a curved design, as seen in FIG. 1, or may be straight or of any suitable shape, as desired.

Handle 12, as seen in FIG. 3, is affixed at its forewardmost end 14 to tube 52 of shaft section 50 by any suitable attachment means. In the embodiment illustrated in FIG. 3, tube 52 is provided with a thickened end section 56 and is press-fit into handle 12.

Substantially centrally located in handle 1 is trigger mechanism 30, which comprises a trigger having a collar member 32 and two opposing radial projections 34,34. Collar member 32 is provided with a central bore 26 through which is disposed stud member 38. Stud member 38, in turn, is affixed to solid portion 16 of handle 12. Spring 40, disposed around stud 38, biases collar member 32 toward the forward portion 14 of handle 12. Trigger mechanism 30 further comprises a pair of detent arms 42,44 located on either side of handle 12, each of which abut projections 34 to prevent undesired movement of collar 32 relative to stud 38. Detent arms 42,44 are each pivotally affixed to handle 12 by stud screws 46,46 or other suitable fasteners, whereby detent arms 42,44 can be selectively pivoted, as illustrated in FIG. 2, to permit the movement of the trigger, through the movement of projections 34, in the left or right directions as viewed in FIG. 3. As seen in FIGS. 2 and 3, handle 12 is provided with apertures 18,18 on its upper and lower surfaces to accommodate the movement of projections 34,34. The significance of the above-mentioned movement of projections 34,34 will be described below in connection with the operation of the device.

Connected to collar member 32, in any known fashion, is a cable 48, which is disposed within tube 52 (See FIG. 1) and terminates in the canister section 100, which will now be described with reference to FIGS. 1 and 4.

Figure 4:
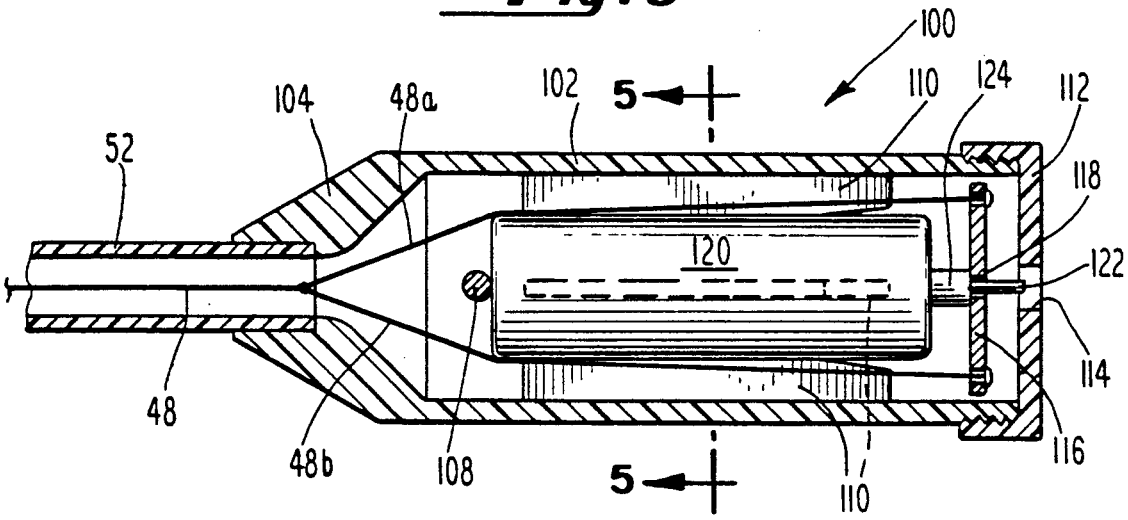
FIG. 4 is a sectional view of the canister housing and canister of the personal protection device according to the present invention.
Figure 5:
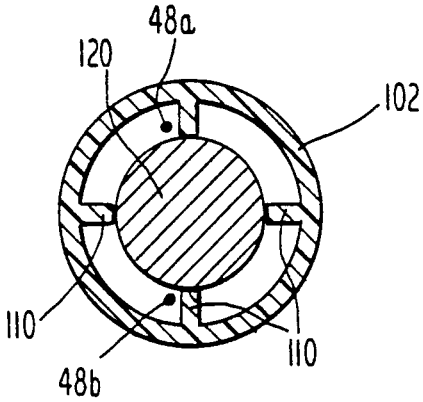
FIG. 5 is a cross-sectioned view of the canister and housing as seen along line 5—5 of FIG. 4.

Canister section 100, as seen in FIGS. 4 and 5, comprises a substantially hollow cylindrical housing 102 having a tapered section 104 at one end and a cap 112 at the other end. Tapered end 104 of housing 102 is affixed to shaft 52 by any known method, such as friction fit or by the use of a suitable adhesive. Equally spaced about the inner circumferential wall of housing 102 are a plurality of longitudinal rib members 110 which are shaped to position and hold a pressurized spray canister 120 centrally within housing 102. A pin 108, is transversely disposed through housing 102 between rib members 110 and tapered section 104. The significance of transverse pin 108 will be described below in connection with the operation of the device.

In the preferred embodiment, housing 102 is of injection molded plastic construction, with the longitudinal rib members 110 being integral with the housing 102.

Cap 112, as seen in FIG. 4, is removably affixed to housing 102 by a threaded connection and is provided with an aperture 114 substantially centrally located therein.

As also seen in FIGS. 4 and 5, cable 48 branches off at canister section 100 into two segments 48*a* and 48*b*. Cable segments 48*a* and 48*b* are disposed within housing 102 and terminate in a disk-like member 116 in such a manner that movement of cable 48 in the longitudinal directions causes similar movement of disk member 116. Disk 116, like cap 112, is also provided with a generally centrally located aperture 118 and is positioned to engage stepped section 124 of nozzle 122 of canister 120, as shown in FIG. 4. Upon movement of stepped section 124 toward canister 120, the contents of canister 120 is discharged. Upon release of cable 48, the pressure inside of canister 120 will bias stepped section 124 outwardly and close off the canister nozzle so that no more spray is emitted. It is to be understood that the type of spray pattern (e.g. stream, wide angle, etc.) emitted from the canister is a function of the nozzle used and may be varied by simply replacing nozzle 122.

With reference now being made to FIGS. 1-4, the operation the personal protection device in accordance with the present invention will now be described. In the preferred embodiment illustrated in the figures, the first line of defense against an animal attack would be to deploy the umbrella. This is accomplished by simply actuating the umbrella detent means 60 in known fashion. In the embodiment illustrated in FIG. 1, this would comprise the depression of detent button 61 which, in turn, would cause detent member 62 to retract. Umbrella collar 72 could then be slid manually along shaft 52 in the direction of arrow 65 or would be pulled in that direction by spring 54 as is known from automatic type umbrellas. In any event, the movement of collar 72 would cause the canopy 70 to open into the position illustrated in broken lines in FIG. 1.

Should the deployment of the umbrella canopy be ineffective in deterring the attacking animal, the second stage of defense, i.e., the discharge of the canister contents, would be used. To actuate the canister and cause a discharge of its contents, the first step is to pivot arm 44 clockwise about stud 46 in the direction of arrow 45 as seen in FIG. 2. By grasping projections 34 and applying a squeezing motion, trigger collar 32 is moved leftwardly as seen in the Figures, against the bias of spring 40. The movement of collar 32, in turn, creates tension in cable 48 which, in turn, causes movement of disk 116 and a corresponding movement of stepped section 124 of canister nozzle 122 and the contents of canister 120 is released and is discharged through aperture 114. Rearward movement of canister 110 is prevented by transverse pin 108 and by the friction from rib members 110. Upon release of trigger projections 34, trigger collar 32 and stepped section 124 return to their forward positions and the discharge of the contents of canister 120 is terminated.

Once the attack has ended, detent arm 44 is pivoted back into its original position, which prevents trigger projections 34 from being moved and thus prevents any accidental discharge of canister 120. Umbrella canopy 70 is returned to its undeployed position by simply sliding collar 72 along shaft 52 until it contacts detent member 62 where it is retained until it is again needed to be deployed.

From time to time, it may be necessary to replace an empty canister with a filled canister, so that the device is always ready for use against an attack. In such situations, cap 112 is first removed from member 102. Detent arm 42 is then pivoted in the direction of arrow 43 shown in FIG. 2 and trigger collar 32 is moved forward by pushing on projections 34. The forward movement of collar 32 creates slack in cable 48 whereby disk 116 can be pulled forward and out of engagement with nozzle 122. Canister 120 can then be removed and replaced with a fresh canister before replacing disk 116, releasing projections 34 and engaging detent arm 42.

Preferred embodiments of the present invention have been illustrated and described herein for purposes of understanding the invention. Various modifications or alternatives may suggest themselves to one skilled in the art upon a reading of the foregoing, all of which are intended to be within the spirit and scope of the invention as defined in the appended claims.

We claim:

1. A personal protection device, comprising:

(a) a handle having movable trigger means connected thereto;

(b) wherein said trigger means comprises:

(1) a stud affixed to said handle;

(2) a collar slidably disposed about said stud;

(3) a pair of radial projections extending from said collar; and (4) a pair of detent arms pivotally mounted to said handle and positioned to selectively engage said radial projections;

(c) an elongate shaft connected to said handle and longitudinally extending therefrom;

(d) canister means connected to said shaft at a terminal end thereof remote from said handle, said canister means having actuator means for actuating the discharge of a canister; and (e) a cable operably connecting said trigger means to said actuating means whereby upon movement of said trigger means, said actuator means is actuated to cause the discharge of a canister.

2. The device of claim 1, wherein said elongate shaft comprises an elongate tubular member and an umbrella canopy disposed about said tubular member, said umbrella canopy being selectively movable between opened and closed positions.

3. The device of claim 2, wherein said shaft further comprises detent means operatively connected to said umbrella canopy for securing said umbrella canopy in the closed position.

4. The device of claim 3, wherein said shaft further comprises spring means connected to said umbrella canopy for biasing said umbrella canopy into the opened position.

5. The device of claim 4, wherein said umbrella canopy, when in the open position, has a concave surface disposed outwardly away from said handle.

6. The device of claim 1, wherein said canister means comprises:

a) a canister housing adapted to receive a gas charged canister containing a noxious spray therein;

b) means for restricting the movement of a canister within said housing, said restricting means comprising a plurality of longitudinal rib members circumferentially spaced about an internal surface of said housing and a pin transversely disposed through said housing; and c) a cap removably disposed on said housing to facilitate installation and removal of a gas charged canister within said housing.

7. The device of claim 6, wherein said actuator means comprises a disk-like member disposed within said housing and affixed to said cable, said member having an aperture therein adapted to receive a nozzle of a gas charged canister.

8. The device of claim 7, further comprising a gas charged canister containing pepper spray for insertion within said canister housing.

9. A personal protection device, comprising:

(a) a handle having movable trigger means connected thereto, wherein said trigger means is movable in two opposing directions from a position of rest;

(b) an elongated shaft connected to said handle and longitudinally extending therefrom;

(c) canister means connected to said shaft at a terminal end thereof remote from said handle, said canister means having actuator means for actuating the discharge of a canister; and (d) a cable operably connecting said trigger means to said actuator means whereby upon movement of said trigger means in a first direction from a position of rest, said actuator means is actuated to cause the discharge of a canister.

10. The device of claim 9, wherein said canister means comprises:

a) a canister housing adapted to receive a gas charged canister containing a noxious spray therein;

b) means for restricting the movement of a canister within said housing, said restricting means comprising a plurality of longitudinal rib members circumferentially spaced about an internal surface of said housing and a pin transversely disposed through said housing; and c) a cap removably disposed on said housing to facilitate installation and removal of a gas charged canister within said housing.

11. The device of claim 10, wherein said actuator means comprises a disk-like member disposed within said housing and affixed to said cable, said member having an aperture therein adapted to receive a nozzle of a gas charged canister.

12. The device of claim 10, wherein said canister means is disposed along a longitudinal axis of said elongate shaft.

13. The device of claim 12, wherein said discharge of a canister is in a direction along the longitudinal axis of said elongate shaft.

14. The device of claim 9, wherein said trigger means comprises:

(a) a stud affixed to said handle;

(b) a collar slidably disposed about said stud, said collar being fixedly connected to said cable;

(c) a pair of radial projections extending from said collar; and (d) a pair of detent arms pivotally mounted to said handle and positioned to selectively engage said radial projections.

15. The device of claim 9, wherein movement of said trigger means in a second direction from a position of rest, opposite said first direction, loosens said cable to facilitate installation and removal of a canister.

16. The device of claim 9, wherein said elongate shaft comprises an elongate tubular member and an umbrella canopy being selectively movable between opened and closed position.

17. The device of claim 16, wherein said umbrella canopy, when in the open position, has a concave surface disposed outwardly away from said handle.

18. A personal protection device, comprising:

(a) a handle having movable trigger means connected thereto;

(b) an elongate shaft connected to said handle and longitudinally extending therefrom;

(c) canister means connected to said shaft at a terminal end thereof remote from said handle, said canister means having actuator means for actuating the discharge of a canister, (d) a cable operably connecting said trigger means to said actuator means whereby upon movement of said trigger means, said actuator means is actuated to cause the discharge of a canister;

(e) wherein said canister means comprises:

(1) a canister housing adapted to receive a gas charged canister containing a noxious spray therein;

(2) means for restricting the movement of a canister within said housing, said restricting means comprising a plurality of longitudinal rib members circumferentially spaced about an internal surface of said housing; and (3) a cap removably disposed on said housing to facilitate installation and removal of a gas charged canister within said housing; and (f) wherein said actuator means comprises a disk-like member disposed within said housing and affixed to said cable, said member having an aperture therein adapted to receive a nozzle of a gas charged canister.

19. The device of claim 18, further comprising a gas charged canister containing pepper spray for insertion within said canister housing.

20. The device of claim 18, wherein said elongate shaft comprises an elongate tubular member and an umbrella canopy disposed about said tubular member, said umbrella canopy being selectively movable between opened and closed positions.

21. The device of claim 20, wherein said umbrella canopy, when in the open position, has a concave surface disposed outwardly away from said handle.

* * * * *

UNITED STATES PATENT AND TRADEMARK OFFICE

CERTIFICATE OF CORRECTION

PATENT NO. : 5,065,904

DATED : November 19, 1991

INVENTOR(S) : Joseph T. McCaffrey and Stewart P. MCKAY

It is certified that error appears in the above-identified patent and that said Letters Patent is hereby corrected as shown below:

Col. 1, line 30, delete "efficacy" and substitute --efficency--.

Col. 3, line 42, after the words "located in handle" delete "1" and substitute --12--.

Col. 5, line 4, after the word "canister" delete "110" and substitute --120--.

Signed and Sealed this

Twentieth Day of April, 1993

*Attest:*

*Attesting Officer*

MICHAEL K. KIRK

*Acting Commissioner of Patents and Trademarks*